US005526719A

United States Patent [19]

Chen

[11] Patent Number: 5,526,719

[45] Date of Patent: Jun. 18, 1996

[54] HAMMER

[76] Inventor: Tung-Yi Chen, 1F No.10, Lane 152, Section 1, Fu Hsing Road, Taichung, Taiwan

[21] Appl. No.: 528,233

[22] Filed: Sep. 14, 1995

[51] Int. Cl.[6] ..... B25D 1/02

[52] U.S. Cl. ..... 81/25; 81/26; 30/308.3; 403/328

[58] Field of Search ..... 81/20, 21, 22, 81/25, 26; 30/308, 308.1, 308.3; 403/328, 326, 321

[56] References Cited

U.S. PATENT DOCUMENTS

| | | | |
|---|---|---|---|
| 334,283 | 1/1886 | Randall | 81/25 |
| 1,253,713 | 1/1918 | Ossman | 81/20 X |
| 1,387,582 | 8/1921 | Bergamini | 81/25 |
| 1,784,683 | 12/1930 | Schweigert | 81/25 X |
| 5,255,575 | 10/1993 | Williams | 81/25 |

*Primary Examiner*—D. S. Meislin
*Attorney, Agent, or Firm*—Bacon & Thomas

[57] ABSTRACT

A hammer including a handle, a base frame at one end of the handle, two hollow holder frames at two opposite ends of the base frame, two U-shaped spring plates respectively mounted inside the holder frames, and two tool elements, which can be bells, claws, hatchet blades, etc., respectively coupled to the holder frames and secured in place by the U-shaped spring plates, and two pairs of control bolts moved in holes on the holder frames and depressed to release the U-shaped spring plates from the tool elements for permitting the tool elements to be disconnected from the holder frames for replacement.

7 Claims, 5 Drawing Sheets

HAMMER

BACKGROUND OF THE INVENTION

The present invention relates to hammers, and relates more particularly to such a hammer which has two holder frames at two opposite ends of the head thereof for replaceably mounting a respective tool element such as a bell, claw, hatchet blade, etc.

A hammer is generally comprised of a handle and a head at one end of the handle. The heads of regular hammers are made of different shapes for different purposes. Therefore, different hammers shall be used for different purposes. There is known a hammer with a replaceable head. This structure of hammer comprises a handle, a base frame fixedly secured to the handle at one end, and a replaceable tool element (which can be a bell, claw, hatchet blade, etc.) fastened to the base frame by screws. For a different working, a different tool element can be fastened to the base frame of the hammer. Because the tool element is fastened to the base frame by screws, it is complicated to disconnect the tool element from the base frame for a replacement. Furthermore, the threads of the screws or the screw holes on the base frame wear away quickly with use.

SUMMARY OF THE INVENTION

The present invention has been accomplished under the circumstances in view. According to one aspect of the present invention, the hammer comprises a handle, a base frame at one end of the handle, two hollow holder frames at two opposite ends of the base frame, two U-shaped spring plates respectively mounted inside the holder frames, and two tool elements, which can be bells, claws, hatchet blades, etc., respectively coupled to the holder frames and secured in place by the U-shaped spring plates, and two pairs of control bolts moved in holes on the holder frames and depressed to release the U-shaped spring plates from the tool elements for permitting the tool elements to be disconnected from the holder frames for replacement. According to another aspect of the present invention, an integral rubber cover is molded on the handle, the base frame, and the holder frames.

DETAILED DESCRIPTION OF THE PREFERRED EMBODIMENT

Figure 1:
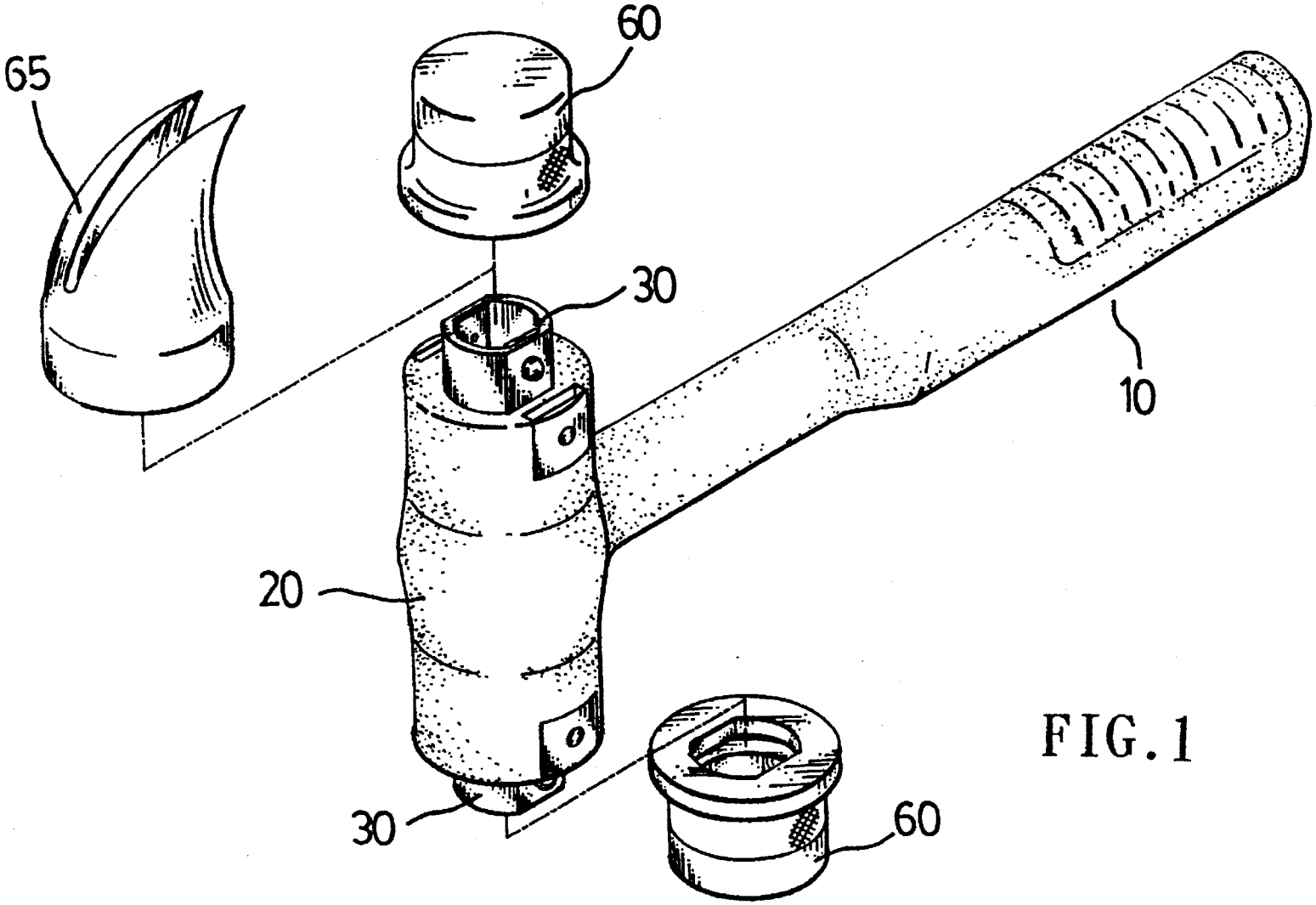
FIG. 1 is a dismantled view of a hammer according to the present invention.

Referring to FIG. 1, a base frame 20 is fastened to a handle 10 at one end. The base frame 20 is a hollow cylinder having two holder frames 30 at two opposite ends for mounting a variety of tool elements such as bells 60, claws 65, blades, etc.

Figure 2:
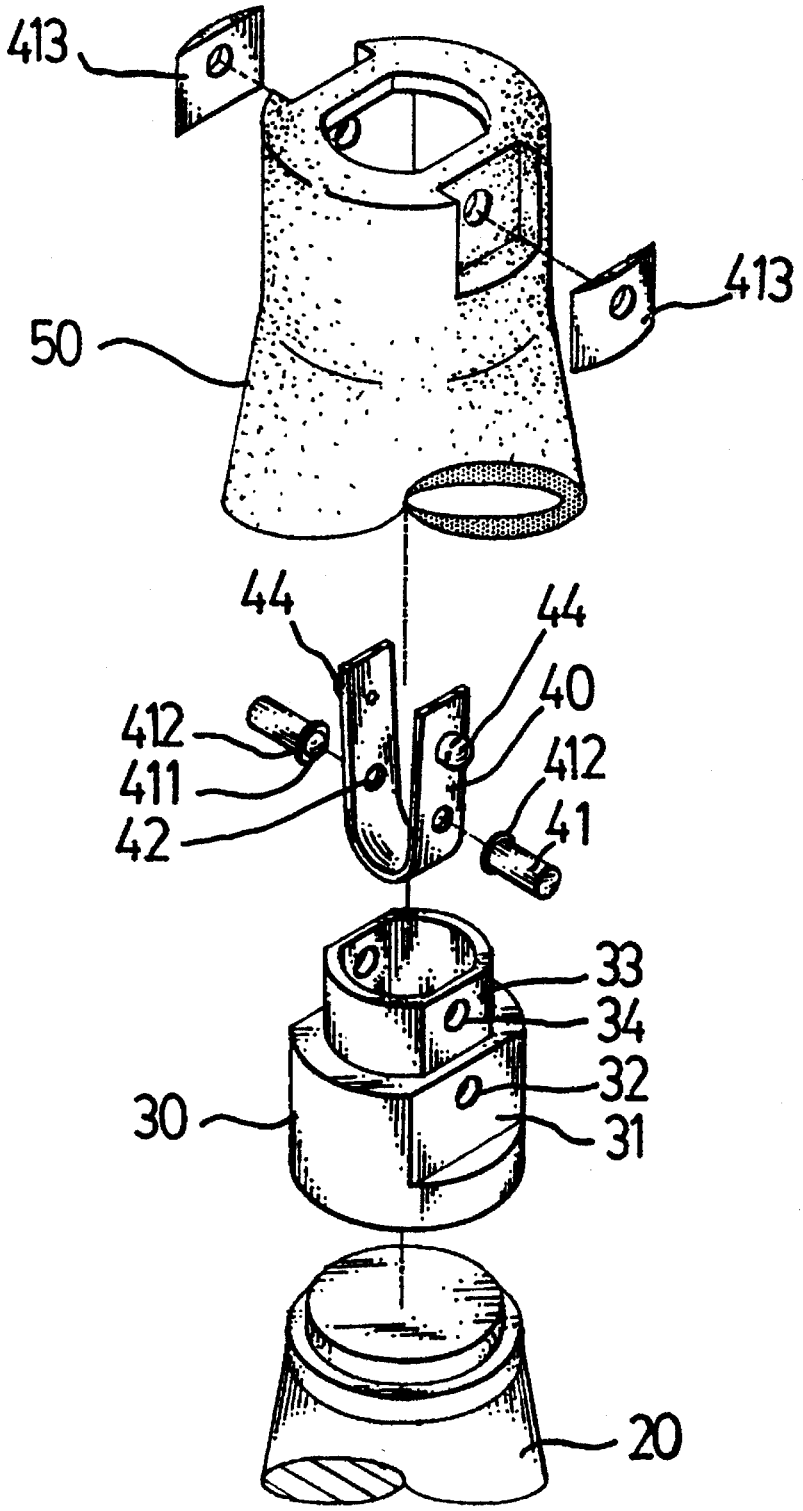
FIG. 2 is an exploded view of one end of the head of the hammer according to the present invention.
Figure 3:
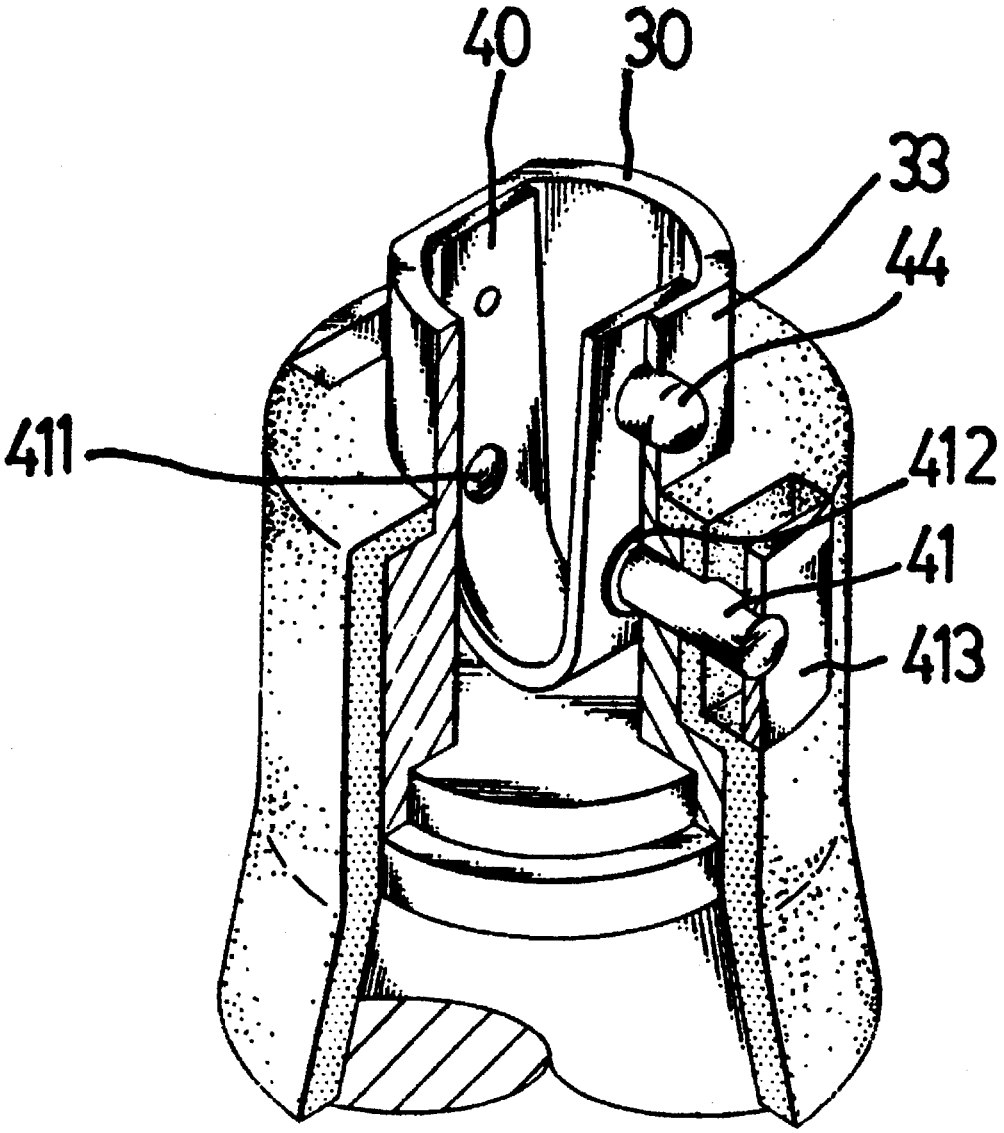
FIG. 3 is a cutaway of one end of the head of the hammer according to the present invention.

Referring to FIGS. 2 and 3, the holder frames 30 are made of hollow structure for holding a respective substantially U-shaped spring plate 40, each having a pair of upper vertical planes 33 and a pair of lower vertical planes 31 at two opposite sides, a pair of upper pin holes 34 through the pair of upper vertical planes 33, and a pair of second pin holes 32 through the pair of lower vertical planes 31. The U-shaped spring plate 40 has two pins 44 perpendicularly raised from the outside wall at two opposite sides and respectively fitted into the upper pin holes 34 of the respective holder frame 30, and two opposite pin holes 42 aligned at two opposite sides below the pins 44. Two control bolts 41 are respectively inserted through the second pair of pin holes 32 of each holder frame 30 from the inside, each having a head 412 at one end stopped against the inside wall of the respective holder frame 30, and a half-round projection 411 raised from the head 412 and inserted into one pin hole 42 of the U-shaped spring plate 40. A rubber covering 50 which is molded from rubber is covered on the handle 10, the base frame 20, and the holder frames 30. Two knobs 413 are respectively fastened to the control bolts 41 of each holder frame 30 and disposed outside the rubber covering 50.

Figure 4:
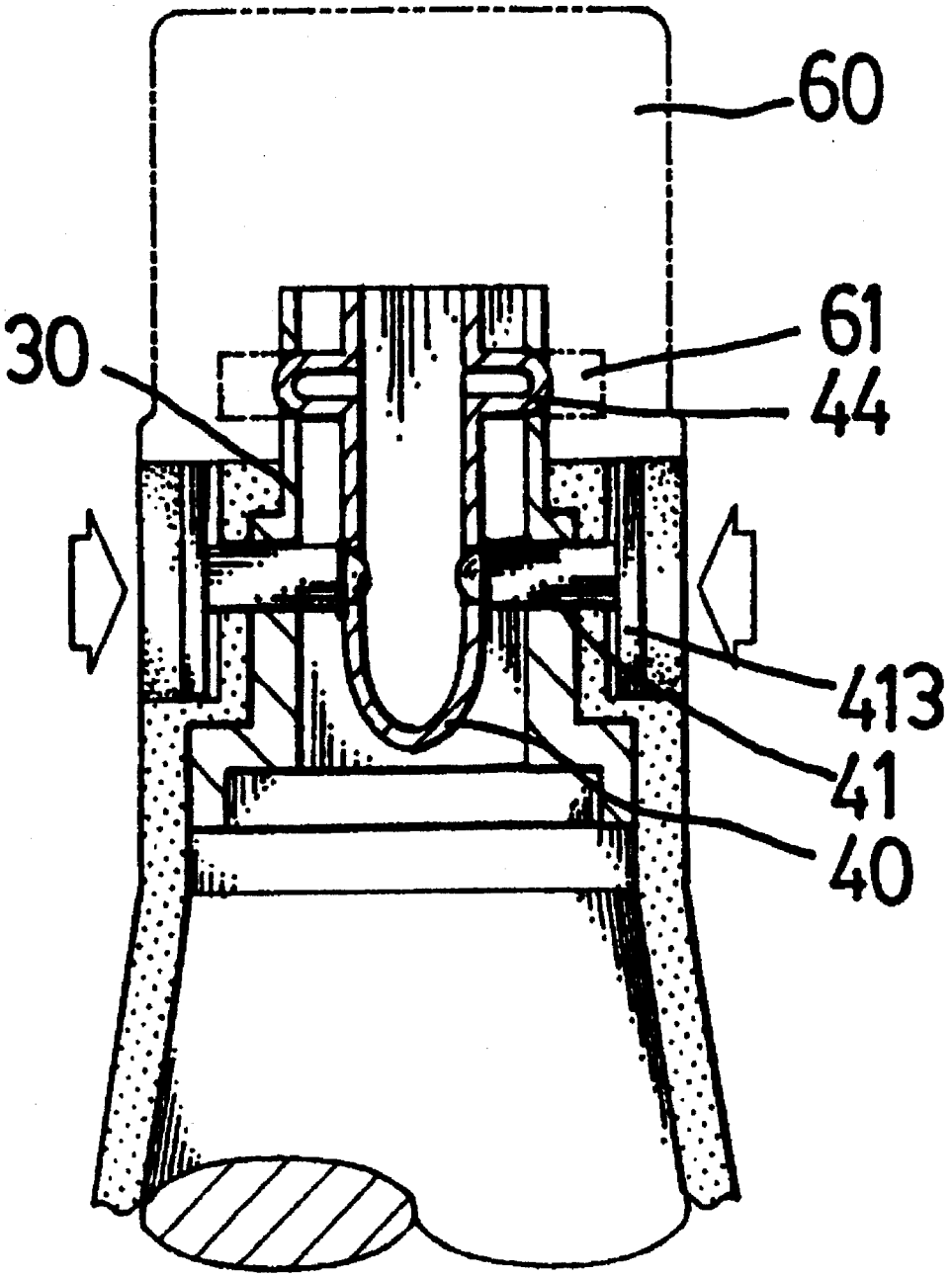
FIG. 4 is a sectional view of one end of the head of the hammer, showing pins of the U-shaped frame disconnected from the bell.
Figure 5:
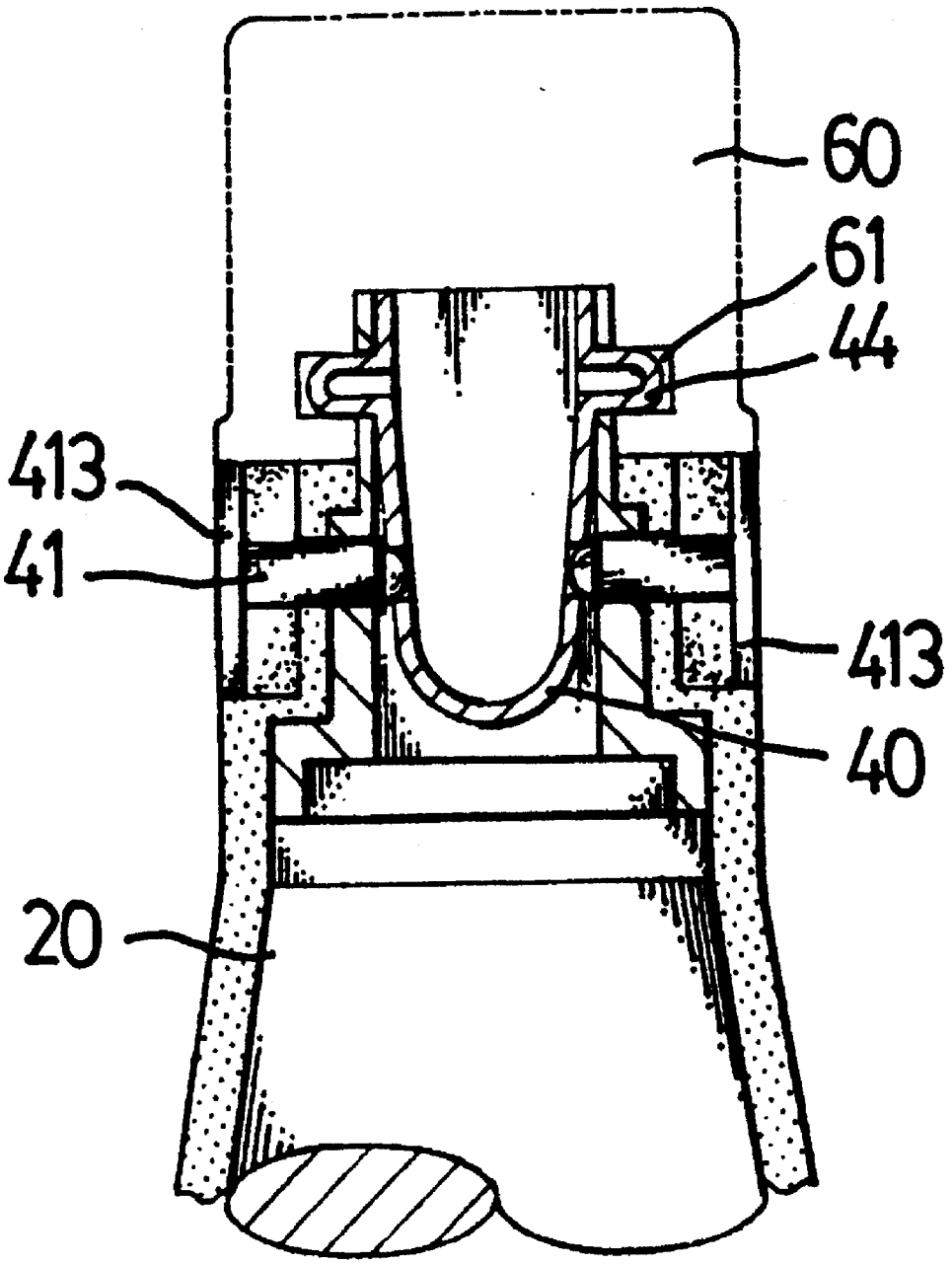
FIG. 5 is similar to FIG. 4 but showing the pins of the U-shaped frame inserted into the locating holes of the bell.

Referring to FIGS. 4 and 5, when the knobs 413 are simultaneously depressed to force the control bolts 41 inwards, the respective U-shaped spring plate 40 is deformed, causing the respective pins 44 disconnected from respective locating holes 61 on the bell 60 being mounted on one holder frame 30, and therefore the bell 60 can be removed from the corresponding holder frame 30 for a replacement (see FIG. 4); when the knobs 413 are released, the U-shaped spring 40 immediately returns to its former shape, causing the pins 44 to insert into the upper pin holes 34 and the locating holes 61 of the bell 60 (or claw 65) to hold the bell 60 (or claw 65) in place.

It is to be understood that the drawings are designed for purposes of illustration only, and are not intended as a definition of the limits and scope of the invention disclosed.

I claim:

1. A hammer comprising a base frame at one end of a handle thereof, two hollow holder frames at two opposite ends of said base frame, each holder frame having a pair of upper vertical planes and a pair of lower vertical planes at two opposite sides, a pair of upper pin holes through said pair of upper vertical planes, and a pair of second pin holes through said pair of lower vertical planes, two replaceable tool elements respectively fastened to said holder frames, each tool element having two opposite locating holes inside a bottom coupling end thereof, two U-shaped springs respectively mounted inside said holder frames to hold said tool elements in place, each U-shaped spring having two pins at two opposite sides inserted through the upper pin holes of one holder frame into the locating holes of the corresponding tool element, and two pairs of control bolts respectively mounted in the lower pin holes of said holder frames, each control bolt having one end extended out of the respective holder frame and an opposite end terminating in a head disposed inside the respective holder frame and stopped against one side of the U-shaped spring plate in the respective holder frame, said U-shaped spring plates being deformed to release the respective pins from the locating holes of said tool elements for permitting said tool elements to be disconnected from said holder frames when said control bolts are depressed to compress said U-shaped spring plates.

2. The hammer of claim 1 wherein said tool elements include at least one bell.

3. The hammer of claim 1 wherein said tool elements include at least one claw.

4. The hammer of claim 1 wherein said tool elements include at least one hatchet blade.

5. The hammer of claim 1 further comprising an integral rubber covering on said handle, said base frame, and said holder frames.

6. The hammer of claim 1 wherein each control bolt has a half-round projection raised from the head thereof and inserted into a round hole at one side of one U-shaped spring plate.

7. The hammer of claim 1 wherein each control bolt has one end extended out of the respective holder and coupled with a knob for pressing by hand.

* * * * *